United States Patent [19]

Rockwell

[11] Patent Number: 4,623,144

[45] Date of Patent: Nov. 18, 1986

[54] WEIGHT LIFTING TYPE ABDOMINAL/BACK EXERCISING APPARATUS

[75] Inventor: Gary Rockwell, LaGrange, Ga.

[73] Assignee: Diversified Products Corporation, Opelika, Ala.

[21] Appl. No.: 696,704

[22] Filed: Jan. 31, 1985

[51] Int. Cl.[4] ..... A63B 21/00

[52] U.S. Cl. ..... 272/134; 272/118; 272/DIG. 4

[58] Field of Search ..... 272/93, 116, 117, 118, 272/130, 134, 143, 136, 142, DIG. 4

[56] References Cited

U.S. PATENT DOCUMENTS

| | | | |
|---|---|---|---|
| 4,169,589 | 10/1979 | McArthur | 272/118 |
| 4,183,520 | 1/1980 | Chase | 272/130 |
| 4,200,279 | 4/1980 | Lambert | 272/118 |
| 4,231,568 | 11/1980 | Riley et al. | 272/136 |
| 4,405,128 | 9/1983 | McLaughlin et al. | 272/134 |
| 4,407,495 | 10/1983 | Wilson | 272/134 X |

FOREIGN PATENT DOCUMENTS

| | | | |
|---|---|---|---|
| 121902 | 10/1984 | Fed. Rep. of Germany | 272/134 |

OTHER PUBLICATIONS

"Continental" and A/B-1 brochures, 1/1985.

*Primary Examiner*—Richard J. Apley
*Assistant Examiner*—Robert W. Bahr
*Attorney, Agent, or Firm*—Banner, Birch, McKie & Beckett

[57] ABSTRACT

An abdominal/back exercising apparatus having a lever assembly engageable buy either the front or the back of the user's torso and pivotable in either a first direction from a null position a second opposite direction from the null position to pull a flexible element which actuates a resistance mechanism. The flexible element may be a strap, and the resistance mechanism a stack of selectable weights.

14 Claims, 4 Drawing Figures

WEIGHT LIFTING TYPE ABDOMINAL/BACK EXERCISING APPARATUS

BACKGROUND OF THE INVENTION

This invention relates to physical exercising apparatus and, more particularly, to exercising apparatus specifically designed for exercising the muscles of the abdomen and back.

A wide variety of exercising apparatus abounds in the prior art. Many of these are multi-purpose exercisers which are usable in many ways for performing a wide variety of exercises. Others are designed to exercise specific muscle groups or specific areas of the body. The abdominal muscles are one such group, with several machines specifically designed for exercising those muscles.

The abdominal muscles and those of the lower back are antagonistic, i.e., they oppose and limit the movement of one another. Proper strength and muscle tone of each group is important for proper posture and overall physical health. However, the muscles of the lower back tend to be quite neglected, as evidenced by the large percentage of the population with lower back problems. Indeed, few exercise devices are designed specifically for exercising those muscles. Considering the interaction between the abdominal muscles and those of the lower back, it would be highly desirable to have available a device for exercising both groups of muscles.

SUMMARY OF THE INVENTION

It is, therefore, an object of the invention to provide an exercising apparatus for exercising the abdominal muscles and those of the lower back.

Another objection of the invention is to provide such an apparatus which involves little, if any, adjustment or reconfiguration when changing from one type of exercise to the other.

Another object of the invention is to provide such an apparatus which can provide a wide range of variable resistance, beginning at very low values.

Another object of the invention is to provide such an apparatus which is easily adjustable to accommodate users of different size.

These and other objects of the invention are accomplished by providing an abdominal/back exercising apparatus comprising a frame; lever means pivotally attached to the frame for pivotal movement about a pivot axis, the lever means having a torso-engaging portion displaced from the pivot axis; an elongated flexible element; movable element engagement means on the lever means displaced from the pivot axis, and fixed element engaging means carried by the frame adjacent and generally medially of the arc of travel of the movable element engaging means. The fixed element engaging means defines a null position of the lever means wherein the element engaging means are nearest one another. One of the element engaging means comprises anchoring means for firmly anchoring a portion of the flexible element, while the other of the element engaging means comprises guide means for retaining the flexible element and guiding its movement through the guide means, whereby pivotal movement of the lever means in either direction from the null position pulls the flexible element through the guide means. The resistance means is carried by the frame and is operatively coupled to the flexible element for resisting pulling movement of the flexible element by the lever means through the guide means. User support means also is carried by the frame for supporting a user with the front or back of the user's upper torso adjacent the torso-engaging portion of the lever means. With this arrangement, bending movement of the user about his waist in either direction against the torso-engaging portion rotates the lever means and pulls the flexible element outwardly through the guide means against the resistive force of the resistance means.

In a preferred embodiment, the guide means is fixed on the frame and the anchoring means is carried by the lever means, displaced further from the pivot axis than the guide means. The torso-engaging portion and the anchoring means preferably are disposed on opposite sides of the pivot axis.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

DESCRIPTION OF THE INVENTION

Figure 1:
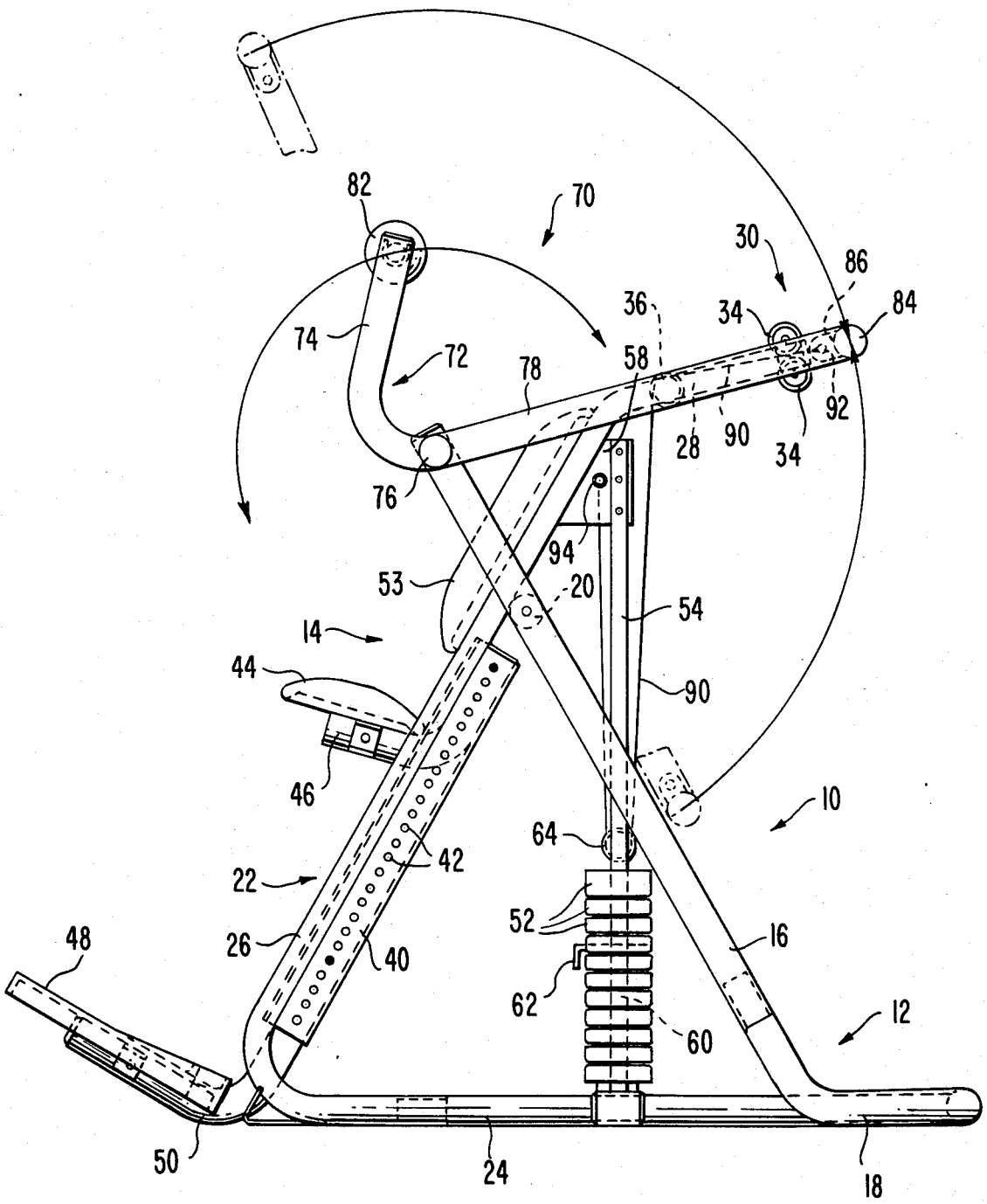
FIG. 1 is a side elevational view of the exercising apparatus according to the invention.
Figure 2:
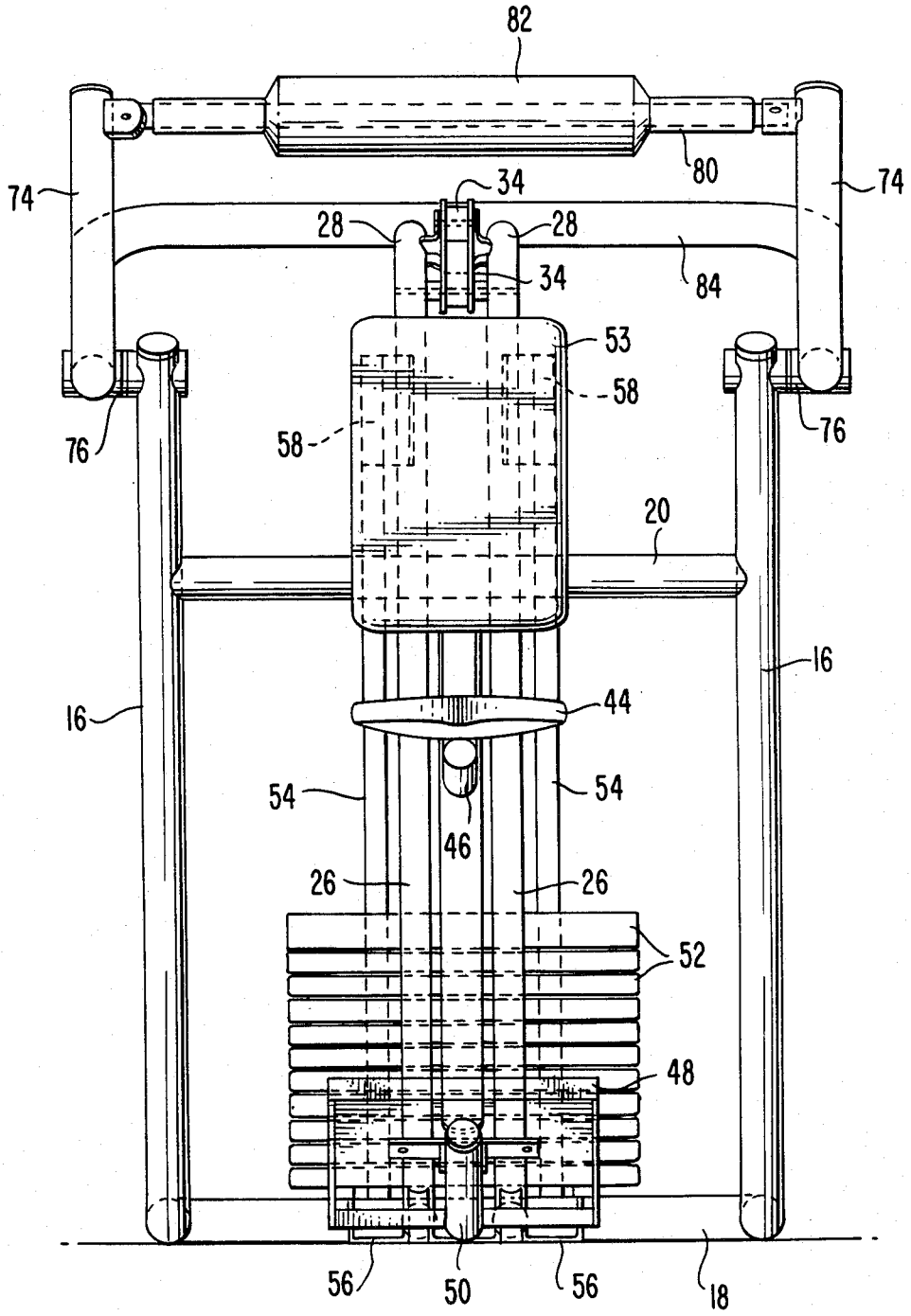
FIG. 2 is a front elevational view of the apparatus as seen from the left in FIG. 1.
Figure 3:
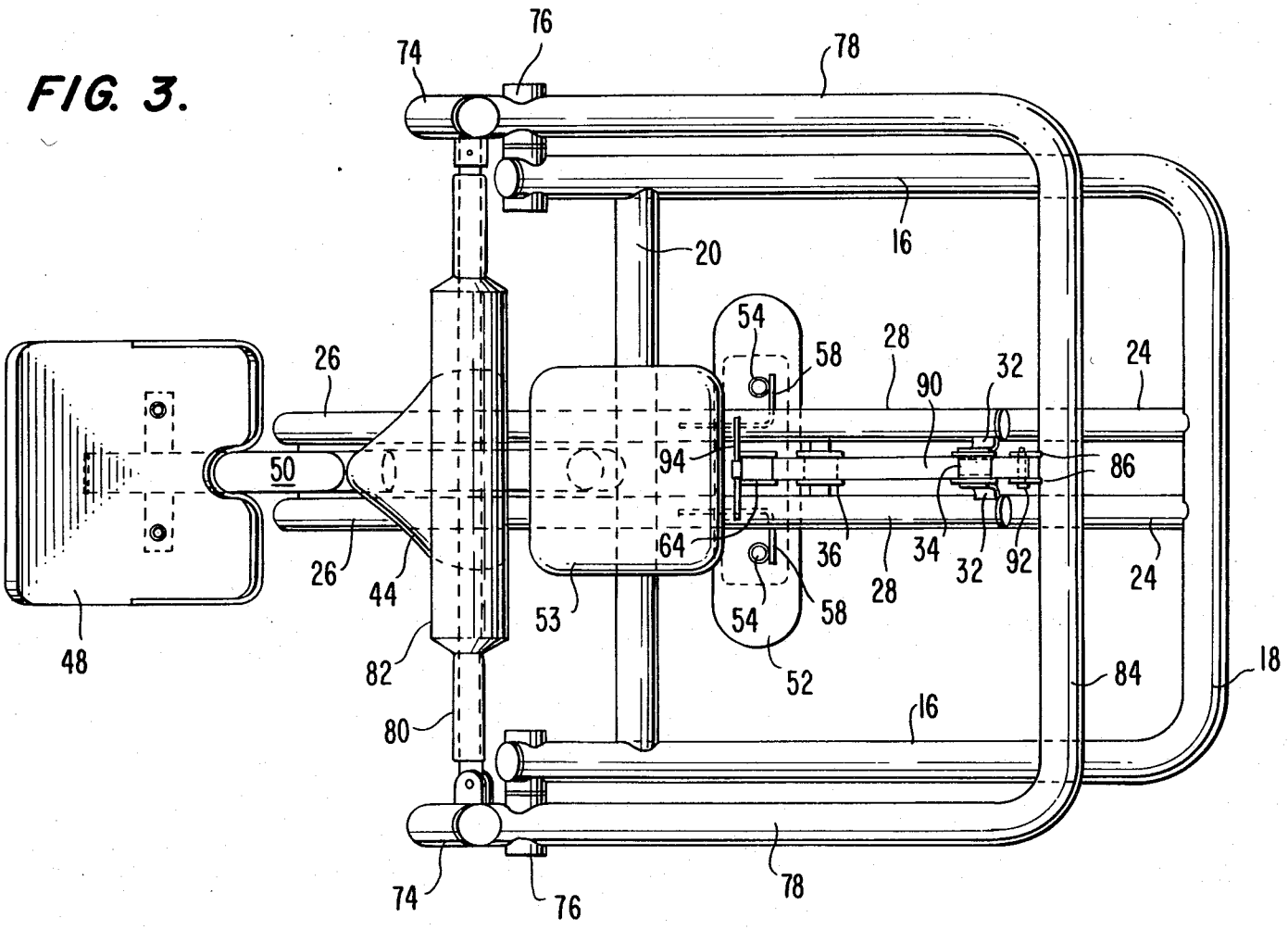
FIG. 3 is a top plan view of the apparatus.

Referring to the figures, the abdominal/back exercising apparatus comprises a free-standing frame 10 made of tubular steel. The frame has two subparts: a rear frame portion 12 and a front frame portion 14. Rear frame portion 12 comprises a parallel pair of angled side members 16 which join a U-shaped base 18. A strut 20 interconnects side members 16 (e.g., by welding) to rigidify the structure.

Front frame portion 14 comprises a pair of parallel members 22 each having a base portion 24 secured to base 18, an inclined front member 26 bearing against or secured to struts 20, and a rearwardly extending upper member 28. The distal ends of upper members 28 support a guide 30 comprising a pair of brackets 32 in which are journaled a pair of spaced sheaves or rollers 34. Also journaled in upper members 28 is a top sheave or roller 36. The purpose of rollers 34 and 36 is explained below.

Secured to inclined front members 26 is a forwardly opening support channel 40 having a plurality of aligned pairs of holes 42 along its length. Channel 40 adjustably supports a seat 44 having an apertured seat post 46 which is pinned in a selected hole 42 at a desired height. Similarly, a platform or foot rest 48 having a mounting post 50 is pinned through a selected hole 42 at a desired height. A backrest 53 is secured to front members 26.

A stack of apertured weights 52 is supported on base 24 and is vertically guided by guide bars 54 which are secured at their lower ends to base 24 through brackets 56, and at their upper ends to brackets 58 welded to inclined front members 26. An apertured weight selector rod 60 extends through a central aperture in weights 52 and is selectively pinned by a pin 62 beneath a selected number of weights. A weight sheave or roller 64 is attached to the upper end of selector rod 60.

Pivoted to the upper ends of side members 16 of rear frame portion 12 is a lever assembly 70 comprising L-shaped side members 72 pivoted adjacent their elbows to side members 16, and having front legs 74 extending forwardly of pivots 76 and rear legs 78 extending rearwardly therefrom. A torso-engaging member 80 interconnects (e.g., by bolts) the distal ends of front legs 74. Torso-engaging member 80 is covered with a cushioning material 82 for comfort during exercise. Rear legs 78 are interconnected by a rear anchoring member 84. An anchoring bracket 86 is welded centrally to anchoring member 84.

Figure 4:
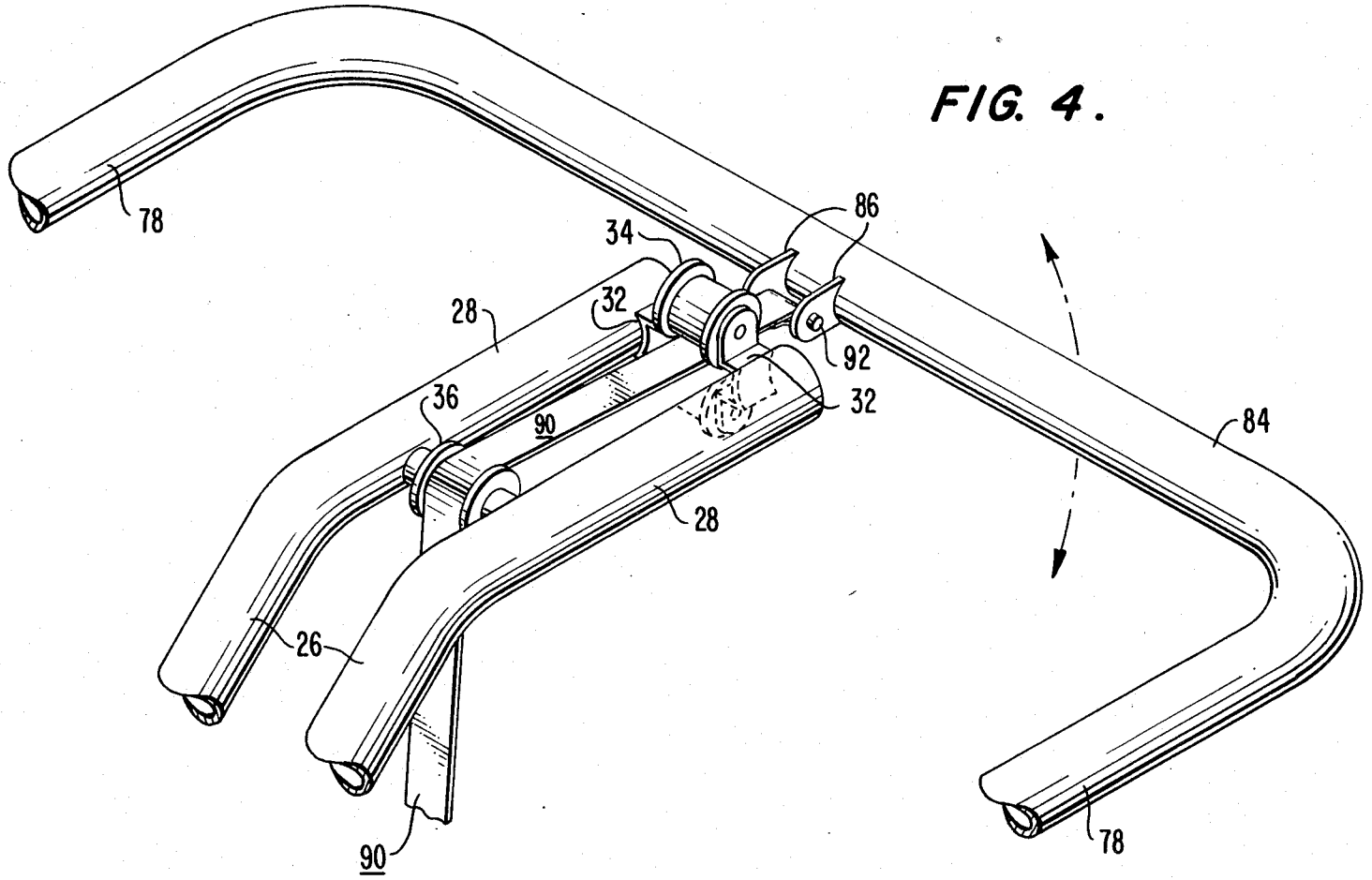
FIG. 4 is a detailed perspective view of the guide means, flexible element and anchoring means of the apparatus .

Referring to FIG. 4, an elongated flexible element 90 in the form of a strap or web is pinned at 92 to anchor brackets 86. Strap 90 is trained over sheave 36, around weight sheave 64 and is pinned at its other end 94 to brackets 58. Thus, if strap 90 is pulled, the selected number of weights 52 will be raised. In FIG. 1, lever assembly 70 is shown in its "null" position, i.e., with guide rollers 34 and anchor brackets 86 nearest one another, and weights 52 at rest. All exercising movement begins with lever assembly 70 at its null position.

In operation, the user selects the appropriate weight to be lifted (i.e., the resistance) by properly positioning pin 62 in weight stack 52. Next, platform 48 and seat 44 are adjusted to proper height so that the user, while seated on seat 44, has his upper torso in engagement with cushion 82 and his feet firmly braced on platform 48. For strengthening the abdominal muscles, the user positions his torso to the right of cushion 82 as seen in FIG. 1, leaning against back rest 53. The user's forward bending movement about the waist rotates lever assembly 70 about pivots 76 in a counter-clockwise direction, ultimately to the limit position illustrated in phantom in FIG. 1. For strengthening the lower back muscles, and user sits on seat 44 with his back against cushion 82 and leans backward to rotate lever assembly 70 in a clockwise direction, as seen in FIG. 1, up to the limit illustrated in phantom. Rotation of lever assembly 70 in either direction will pull strap 90 outwardly through guide rollers 34, thereby raising the selected weights along guide bars 54.

It will be seen that the above described exercising apparatus simply and effectively accomplishes the stated objectives. No reconfiguration of the apparatus is required in order to switch between abdominal and back exercises: the user need only reposition himself on the opposie side of cushion 82. Desired resistance is selected merely by inserting pin 62 in the proper position in the weight stack. The unit is compact, and adjustments for users of different size is easily accomplished by adjustment of seat 44 and platform 48.

It will be obvious to one of ordinary skill that numerous modifications may be made without departing from the true scope of the invention which is to be limited only by the appended claims. For example, the frame may have any configuration as long as the spacial relationships among the various elements allows the device to operate in the manner described. The torso-engaging portion and the anchoring portion of the lever asssembly could, if properly configured, be located on the same side of the pivot axis, and the guide rollers could be mounted to the lever assembly (rather than the frame) and the end of the strap fixed to the frame (rather than the lever assembly). The weights may be replaced with springs or other types of resistance mechanisms. Other modifications will be apparent to those skilled in the art.

I claim:

1. An abdominal/back exercising apparatus comprising:

a frame;

lever means pivotally attached to said frame for pivotal movement about a pivot axis, said lever means having a torso-engaging portion displaced from said pivot axis;

an elongated flexible element operatively coupled to said lever means;

movable element engaging means on said lever means displaced from said pivot axis, and fixed element engaging means carried by said frame adjacent and generally medially of the arc of travel of said movable element engaging means, said lever means being in a null position where said two element engaging means are nearest one another;

one of said movable or fixed element engaging means comprising anchoring means for firmly anchoring a portion of said flexible element;

the other of said movable or fixed element engaging means comprising guide means for retaining said flexible element and guiding its movement through said guide means, wherein pivotal movement of said lever means in either a first direction from said null position or a second opposite direction from said null position pulls said flexible element through said guide means;

resistance means carried by said frame and operatively coupled to said flexible element for resisting pulling movement of said flexible element by said lever means through said guide means; and user support means carried by said frame for supporting a user with the front or back of the user's upper torso adjacent said torso-engaging portion of said lever means, whereby bending movement of the user about his waist in either a forward or backward direction against said torso-engaging portion rotates said lever means and pulls said flexible element outwardly through said guide means against the resistive force of said resistance means.

2. An exercising apparatus according to claim 1 wherein said guide means is fixed on said frame and said anchoring means is carried by said lever means.

3. An exercising apparatus according to claim 2 wherein said anchoring means is displaced further from said pivot axis than said guide means.

4. An exercising apparatus according to claim 3 wherein said torso-engaging portion and said anchoring means are disposed on opposite sides of said pivot axis.

5. An exercising apparatus according to claim 4 wherein said lever means comprises a pair of generally L-shaped side members each pivoted to said frame adjacent its elbow, a padded torso-engaging front member interconnecting the front legs of said side members, and a rear member carrying said anchoring means and interconnecting the rear legs of said side members, said front legs of said side members being generally upright when said lever means is in its null position.

6. An exercising apparatus according to claim 5 wherein said frame comprises an upwardly and rearwardly inclined front portion supporting said user support means, the upper part of said front portion extending rearwardly between the rear legs of said side members and supporting said guide means.

7. An exercising apparatus according to claim 6 wherein said resistance means comprises a vertical guided stack of weights below said guide means, and selector means operatively coupled to said flexible element for lifting a selected number of said weights.

8. An exercising apparatus according to claim 7 wherein said selector means includes a weight sheave at its upper end, and said flexible element is trained around said weight sheave and is anchored to said frame above said weights.

9. An exercising apparatus according to claim 8 further comprising a fixed sheave on said frame above said weight means for directing said flexible element between said guide means and said weight sheave.

10. An exercising apparatus according to claim 9 wherein said guide means comprises closely spaced upper and lower guide sheaves journaled on said frame, said flexible element passing between said guide sheaves.

11. An exercising apparatus according to claim 10 wherein said user support means comprises a height-adjustable seat on said frame below said torso-engaging front member.

12. An exercising apparatus according to claim 11 wherein said user support means further comprises foot bracing means on said frame below said seat.

13. An exercising apparatus according to claim 12 wherein said user support means further comprises a backrest on said frame above said seat.

14. An exercising apparatus according to claim 13 wherein said frame comprises an upwardly and rearwardly inclined front portion supporting said seat and said backrest, the upper part of said front portion extending rearwardly and supporting said fixed sheave and said guide means.

* * * * *